US005549527A

United States Patent [19]

Yu

[11] Patent Number: 5,549,527

[45] Date of Patent: Aug. 27, 1996

[54] STATIONARY BIKE

[76] Inventor: Hui-Nan Yu, No. 91-6, Ming Tsu Rd., Tao Yuan City, Taiwan

[21] Appl. No.: 555,514

[22] Filed: Nov. 8, 1995

[51] Int. Cl.[6] ..... A63B 69/16

[52] U.S. Cl. ..... 482/57; 482/95

[58] Field of Search ..... 482/57, 62, 95, 482/63, 148, 151, 129

[56] References Cited

U.S. PATENT DOCUMENTS

| | | | |
|---|---|---|---|
| 1,796,682 | 3/1931 | Bell | 482/57 |
| 3,134,378 | 5/1964 | Harwood | 482/62 |
| 3,940,128 | 2/1976 | Ragone | 482/62 |
| 4,586,706 | 5/1986 | Chen | 482/62 |
| 4,660,826 | 4/1987 | Lee | 482/57 |
| 5,156,650 | 10/1992 | Bals | 482/57 |

*Primary Examiner*—Stephen R. Crow
*Attorney, Agent, or Firm*—Bacon & Thomas

[57] ABSTRACT

A stationary bike including a stand, a seat and handlebar mounting frame mounted on the stand to hold a saddle and a handlebar at two opposite ends, a transmission gear box mounted in the stand, a crank and pedal assembly pedaled to drive the transmission gear box, and a damping resistance producing device for acting with the transmission gear box to produce a damping resistance upon pedaling of the crank and pedal assembly, wherein the seat and handlebar mounting frame is turned about a pivot on the stand and supported on a link and the transmission gear box is connected to the stand by a pivot such that the seat and handle bar mounting frame is alternatively oscillated up and down when the crank and pedal assembly is pedaled to drive the transmission gear box.

3 Claims, 7 Drawing Sheets

STATIONARY BIKE

BACKGROUND OF THE INVENTION

The present invention relates to stationary bikes, and relates more particularly to such a stationary bike which simulates the riding of a bicycle in alternatively climbing a slope and going down on a descending road.

Various stationary bikes have been developed for indoor exercises, and have appeared on the market. FIG. 1 shows a stationary bike for this purpose. This structure of stationary bike produces a damping resistance when pedaled by the player. However, this structure of stationary bike can only be used for exercising the legs, but cannot simulate the riding of a bicycle in climbing a slope or going down on a descending road.

SUMMARY OF THE INVENTION

The present invention has been accomplished to provide a stationary bike for exercises which simulates the riding of a bicycle in alternatively climbing a slope and going down on a descending road.

According to one embodiment of the present invention, the stationary bike comprises a stand, a seat and handlebar mounting frame mounted on the stand to hold a saddle and a handlebar at two opposite ends, a transmission gear box mounted in the stand, a crank and pedal assembly pedaled to drive the transmission gear box, and a damping resistance producing means for acting with the transmission gear box to produce a damping resistance upon pedaling of the crank and pedal assembly, wherein the seat and handlebar mounting frame is turned about a pivot means on the stand and supported on a link means and the transmission gear box is connected to the stand by pivot means such that the seat and handle bar mounting frame is alternatively oscillated up and down when the crank and pedal assembly is pedaled to drive the transmission gear box.

DETAILED DESCRIPTION OF THE PREFERRED EMBODIMENT

Figure 1:
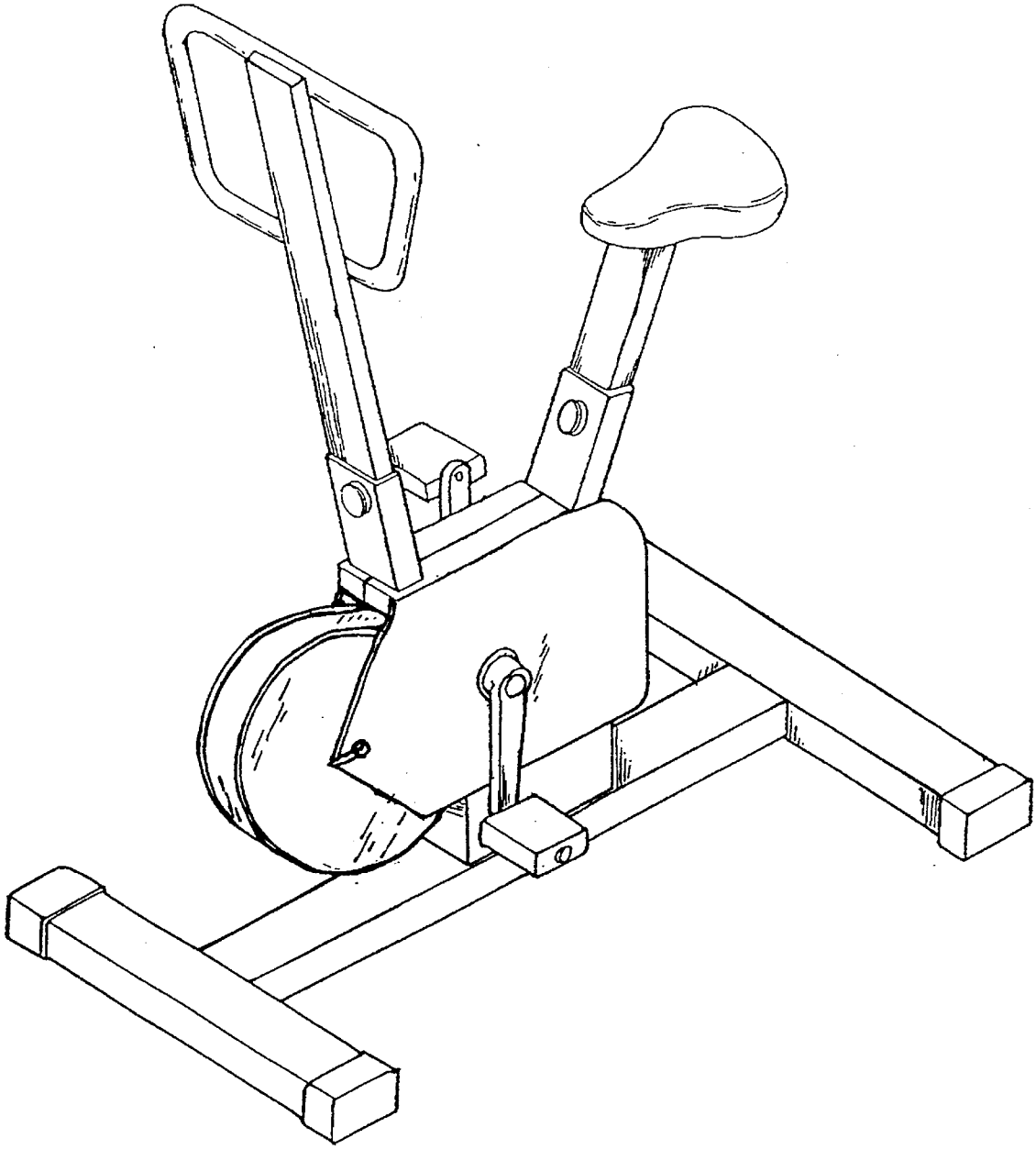
FIG. 1 (PRIOR ART)
FIG. 1 is an elevational view of a stationary bike according to the prior art.
Figure 2:
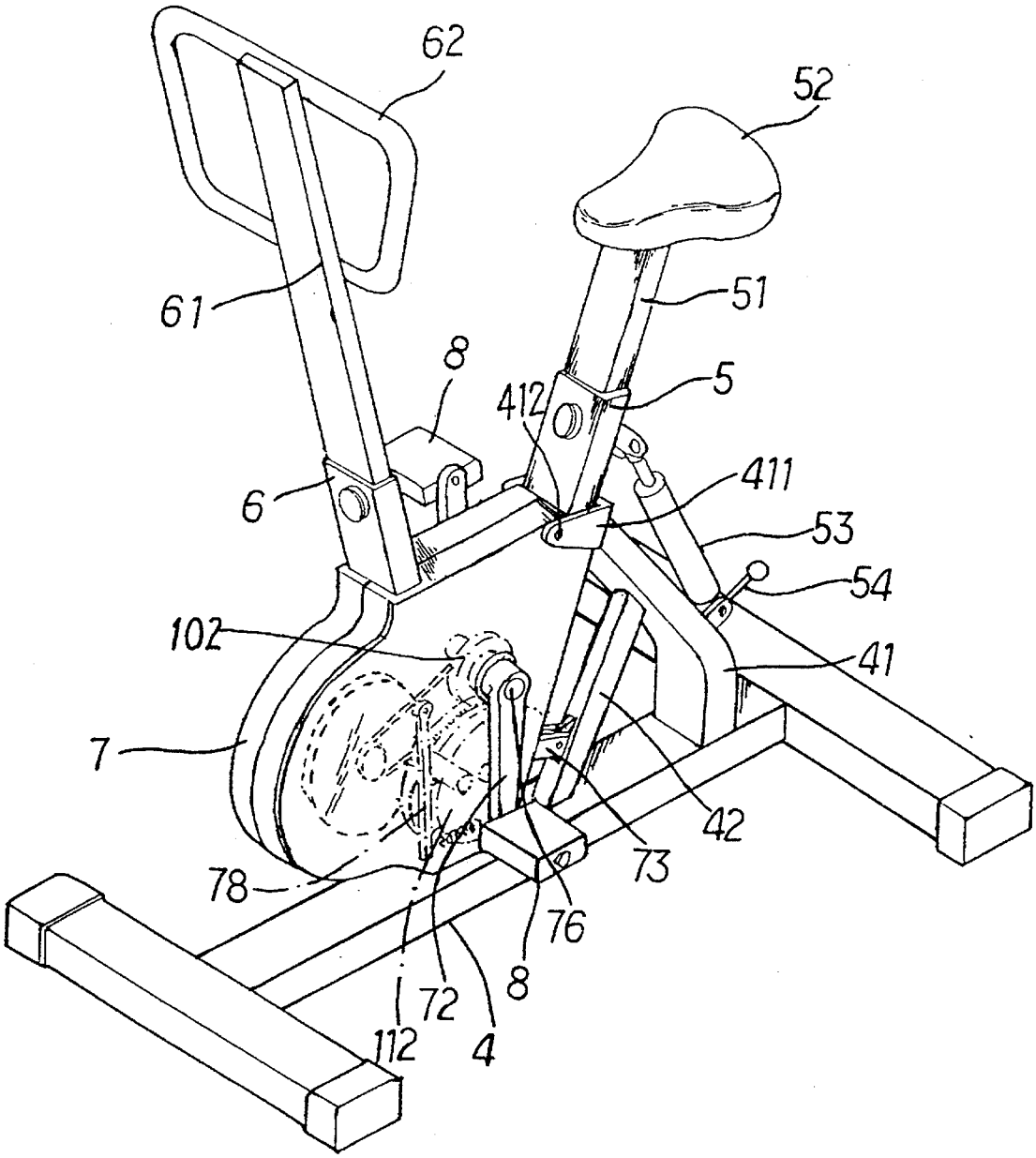
FIG. 2 is a perspective elevational view of a stationary bike according to the present invention.
Figure 3:
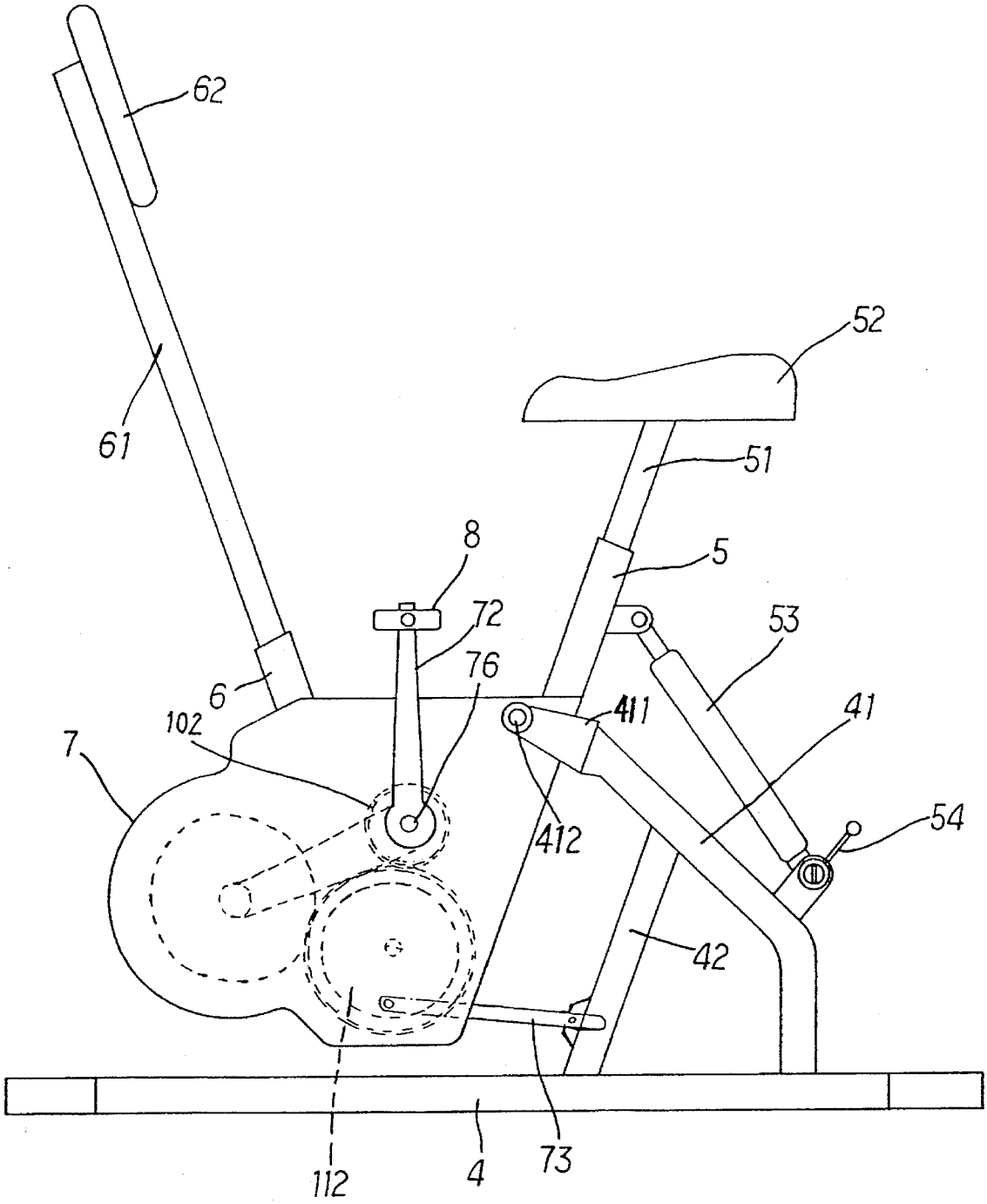
FIG. 3 is a side view of the stationary bike shown in FIG. 2.

Referring to FIGS. 2 and 3, the stationary bike in accordance with the present invention comprises a substantially I-shaped base 4, a curved support 41 raised from the base 4, a brace 42 connected between the curved support 41 and the base 4, a holder frame 411 fixedly secured to the top end of the curved support 41, a transmission gear box 7 pivotably connected to the holder frame 411 and the brace 42 by a pivot 412 and two links 73, a front sleeve 6 and a rear sleeve

5 respectively raised from the top side of the transmission gear box 7, a seat stem 51 fastened to the rear sleeve 5 to hold a saddle 52, an upright bar 61 fastened to the front sleeve 6 to hold a handle 62, a hydraulic cylinder 53 connected between the rear sleeve 5 and the curved support 41, a release control bar 54 controlled to constrain or release the hydraulic cylinder 53, a power input axle 76 coupled to the power input end of the transmission gear box 7, two cranks 72 fixed to two opposite ends of the power input axle 76, two pedals 8 respectively coupled to the cranks 72 at two opposite sides outside the transmission gear box 7 for driving the transmission gear box 7 by legs. The seat stem 51 and the upright bar 61 can be adjusted vertically relative to the rear sleeve 5 and the front sleeve 6 and locked at the desired elevation by a lock.

The transmission gear box 7 comprises a driving gear 102 at the power input end fixedly mounted around the power input axle 76, and a transmission gear 112 meshed with the driving gear 102 and having two eccentric rods (not shown) at two opposite sides respectively coupled to the links 73. When the release control bar 54 is locked to hold down the hydraulic cylinder 53, the transmission gear box 7 will be forced to oscillate back and forth and to simulate the riding of a bicycle in climbing a slope and going down on a descending road. There is a stop bar 78 mounted inside the transmission gear box 7 to hold a brake shoe (not shown) which acts against one side of the transmission gear 112 to produce a damping resistance when the pedals 8 are pedaled.

Figure 4:
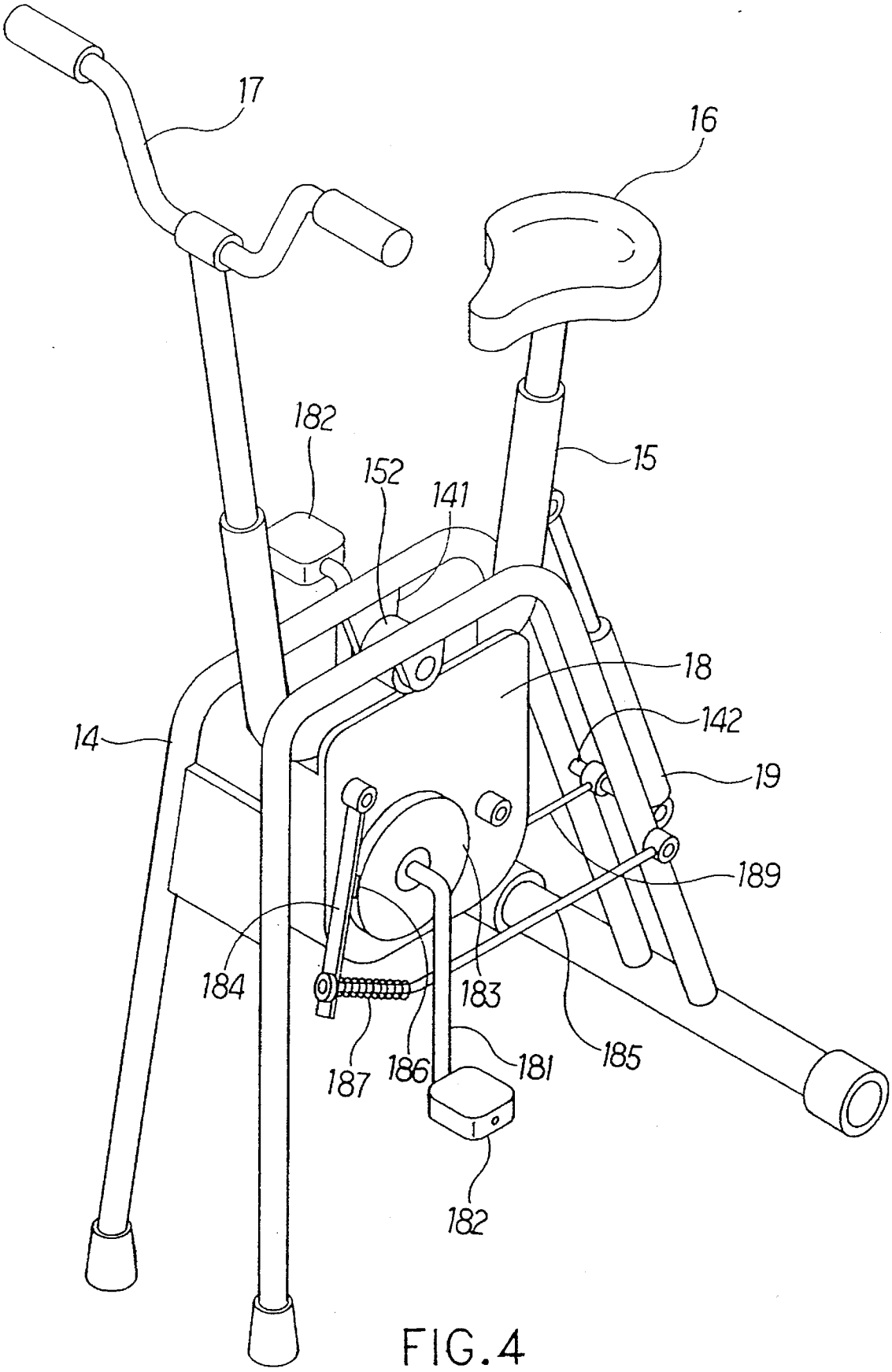
FIG. 4 shows an alternate form of the stationary bike according to the present invention.
Figure 5:
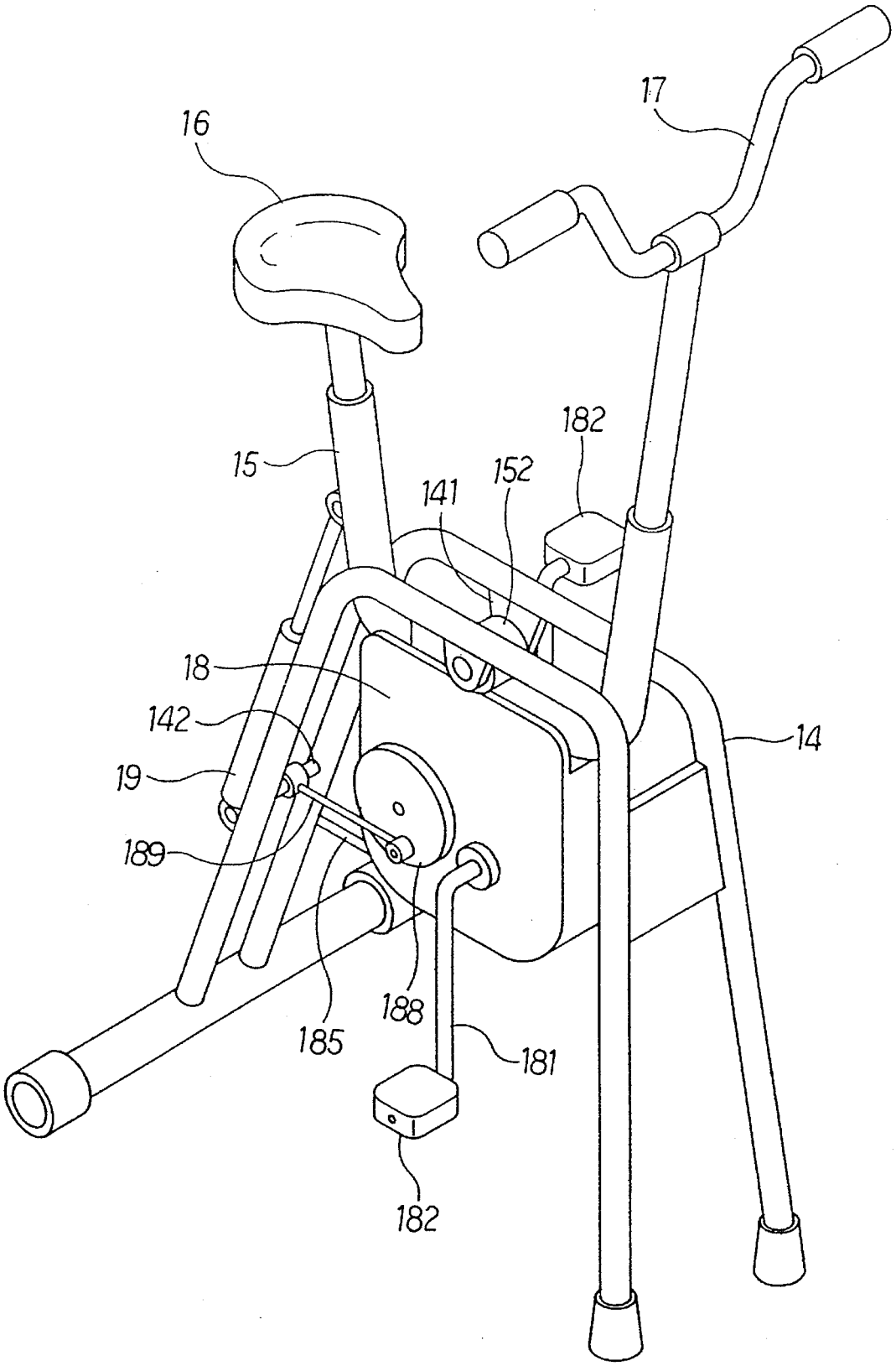
FIG. 5 is an elevational view of the alternate form of FIG. 4 taken from another direction.
Figure 6:
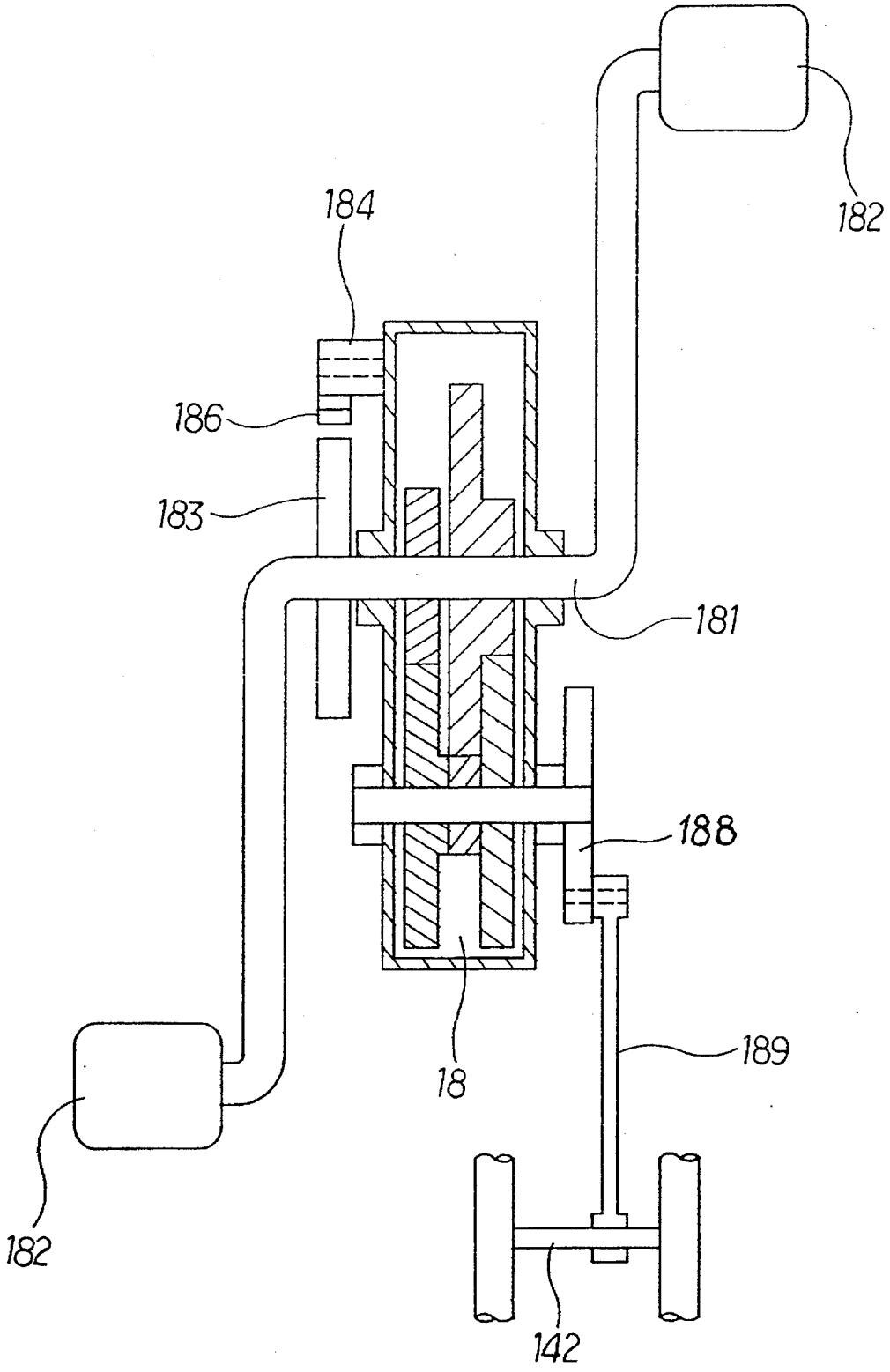
FIG. 6 is a sectional view of the transmission gear box shown in FIG. 4.
Figure 7:
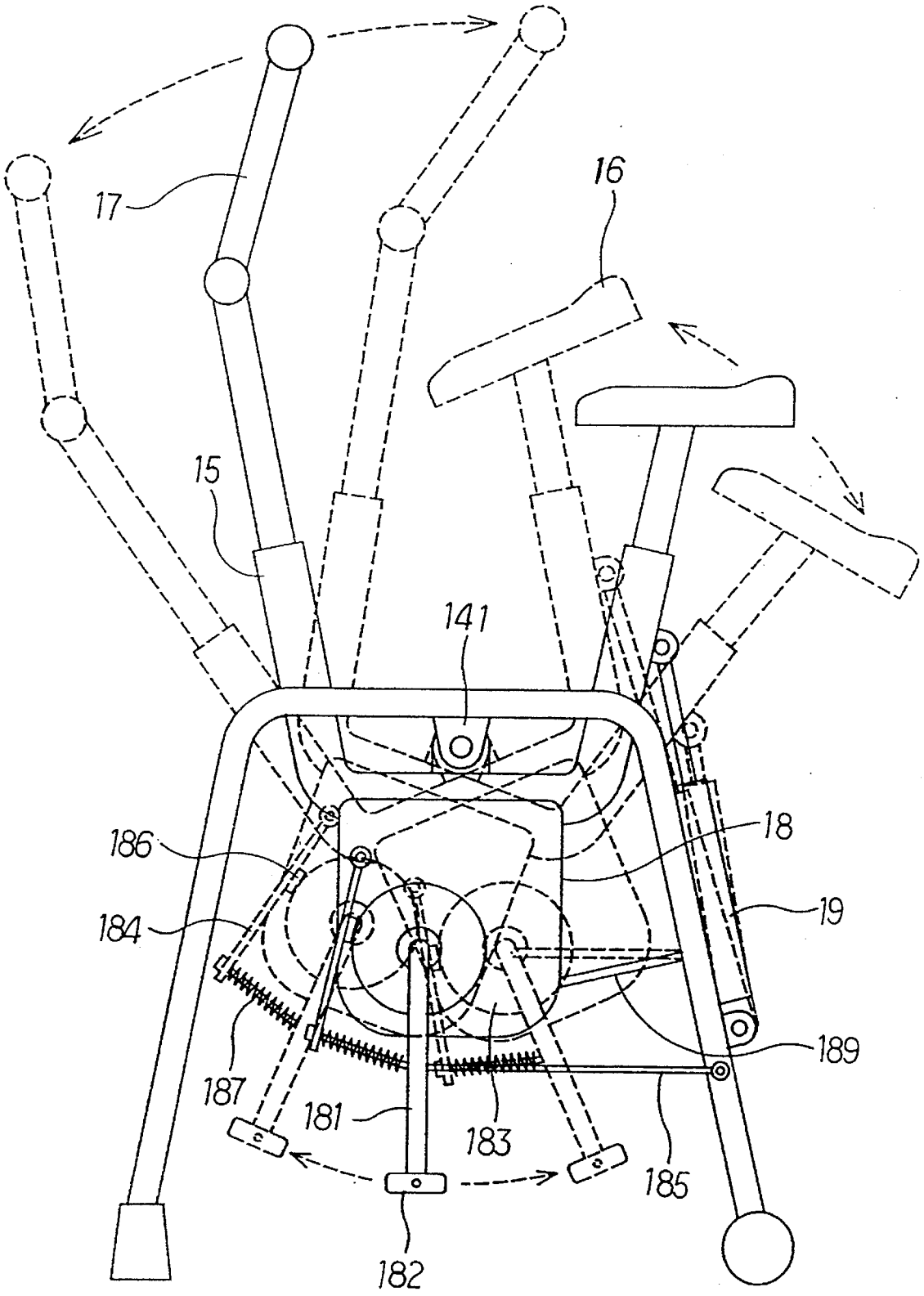
FIG. 7 shows the stationary bike of FIG. 4 operated.

FIGS. 4 and 5 show an alternate form of the present invention. According to this alternate form, the stationary bike comprises a stand 14, an oscillating seat frame 15, and a transmission gear box 18. The oscillating seat frame 15 is a substantially U-shaped frame having a pivot 152 in the middle revolvably connected between two parallel lugs 141 on the stand 14 at the top. The transmission gear box 18 is fixedly secured to the oscillating seat frame 15 and suspended from the stand 14. A saddle 16 and a handlebar 17 are respectively fastened to the two opposite ends of the oscillating seat frame 15 above the stand 14. A hydraulic cylinder 19 is provided having a fixed end fixedly secured to the back side of the stand 14 and a movable end pivotably connected to one end of the oscillating seat frame 15 adjacent to the saddle 16. A pedal crank assembly 181 is fastened to the transmission gear box 18 to hold a pair of pedals 182 at two opposite sides outside the transmission gear box 18. A friction wheel 183 is fixedly mounted around the pedal crank assembly 181 and disposed at the left side outside the transmission gear box 18. An actuating bar 184 is provided, having a fixed end pivotably connected to the transmission gear box 18 on the outside adjacent to the friction wheel 183 and a free end movably connected to a locating rod 185. The locating rod 185 has one end fixedly secured to the back side of the stand 14, and an opposite end loosely coupled to the free end of the actuating bar 184. A spring 187 is mounted around the locating rod 185, having one end fixedly secured to the locating rod 185 and an opposite end stopped at the actuating bar 184. A brake shoe 186 is fixedly secured to the actuating bar 184 at one side and acted against the friction wheel 183o An eccentric wheel 188 is fastened to the transmission gear box 18 at an opposite end relative to the friction wheel 183. A link 189 is provided having one end pivotably connected to the eccentric wheel 188 and an opposite end pivotably connected to a cross bar 142 at the back side of the stand 14. When the transmission gear box 18 is driven by pedals 182, the eccentric wheel 188 is rotated relative to the link 189, causing the transmission gear box 18 moved relative to the stand 14. Because the transmission gear box 18 is fixedly secured to the oscillating seat frame 15 and the oscillating seat frame 15 is pivotably connected between the lugs 141 on the stand 14 and supported on the hydraulic cylinder 19, the oscillating seat frame 15 is oscillated back and forth when the eccentric wheel 188 is rotated by the pedals 182 through the transmission gear box 18. When the oscillating seat frame 15 is oscillated back and forth, the actuating bar 184 is oscillated relative to the friction wheel 183. When the actuating bar 184 is moved toward the friction wheel 183 to rub the brake shoe 186 against the periphery of the friction wheel 183, the handlebar 17 is simultaneously turned by the oscillating seat frame 15 to tilt forwardly downwards. When the actuating bar 184 is moved away from the friction wheel 183 to release the brake shoe 186 from the periphery of the friction wheel 183, the handlebar 17 is simultaneously turned by the oscillating seat frame 15 to tile upwardly backwards. Therefore, the stationary bike simulates the riding of a bicycle in alternatively climbing a slope and then going down on a descending road.

It is to be understood that the drawings are designed for purposes of illustration only, and are not intended as a definition of the limits and scope of the invention disclosed.

I claim:

1. A stationary bike comprising a stand, a pivot means mounted on said stand a seat and handlebar mounting frame pivotally mounted on said pivot means to hold a saddle and a handlebar at two opposite ends, a transmission gear box pivotally mounted to said pivot means, a rotary crank and pedal assembly for driving said transmission gear box, and a damping resistance producing means for acting with said transmission gear box to produce a damping resistance upon pedaling of said crank and pedal assembly, wherein said seat and handlebar mounting frame is turned about said pivot means on said stand supported on a link means such that said seat and handle bar mounting frame is alternatively oscillated up and down when said crank and pedal assembly is pedaled to drive said transmission gear box.

2. The stationary bike of claim 1 wherein said damping resistance producing means comprises a friction wheel mounted in said transmission gear box and turned by said crank and pedal assembly, a brake bar suspended in said transmission gear box, and a brake shoe fixedly mounted on said brake bar to act against said friction wheel.

3. The stationary bike of claim 2 wherein said friction wheel is mounted outside said transmission gear box.

* * * * *